United States Patent [19]

Henriksson

[11] Patent Number: 4,756,634

[45] Date of Patent: Jul. 12, 1988

[54] FRICTION DEVICE FOR THE DRIVE OF A RIBBON OF A TYPEWRITER OR PRINTER

[75] Inventor: Bengt-Åke Henriksson, Svängsta, Sweden

[73] Assignee: Telefonaktiebolaget LM Ericsson, Stockholm, Sweden

[21] Appl. No.: 22,802

[22] PCT Filed: Apr. 22, 1986

[86] PCT No.: PCT/SE86/00183

§ 371 Date: Jan. 24, 1987

§ 102(e) Date: Jan. 24, 1987

[87] PCT Pub. No.: WO86/06685

PCT Pub. Date: Nov. 20, 1986

[30] Foreign Application Priority Data

May 9, 1985 [SE] Sweden ..... 8502320

[51] Int. Cl.[4] ..... B41J 35/28

[52] U.S. Cl. ..... 400/207; 400/223

[58] Field of Search ..... 400/223, 225, 234, 636, 400/636.3, 637, 637.3, 639, 196, 196.1, 208, 208.1, 207; 68/244

[56] References Cited

U.S. PATENT DOCUMENTS 3,269,626 8/1966 Albrecht ..... 226/194 X
3,849,798 11/1974 Ono ..... 226/194

FOREIGN PATENT DOCUMENTS 0083926 7/1983 European Pat. Off. ..... 400/234
0008679 1/1983 Japan ..... 400/636

*Primary Examiner*—Edgar S. Burr
*Assistant Examiner*—James Lisehora
*Attorney, Agent, or Firm*—Roberts, Spiecens & Cohen

[57] ABSTRACT

A friction device, preferably for printer-typewriter ribbons, intended to provide engagement between a drive roller and the ribbon and wherein a counter pressure roller is supported by a flexible shaft in the form of a helical spring which is mounted at a distance from the peripheral driving surface of the drive roller which is less than the radius of the counter pressure roller.

4 Claims, 1 Drawing Sheet

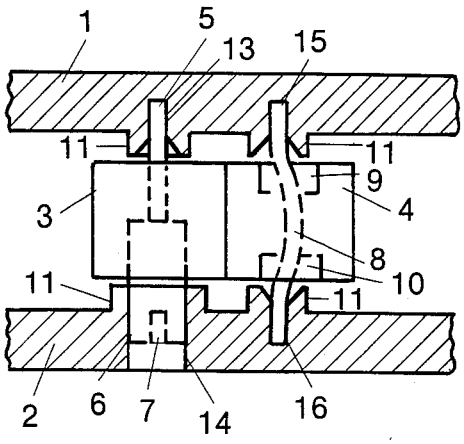
1
5
13
15
11
11
9
3
4
8
10
11
11
2
6
7
14
16

FRICTION DEVICE FOR THE DRIVE OF A RIBBON OF A TYPEWRITER OR PRINTER

FIELD OF THE INVENTION

The invention relates to a friction device, preferably in typewriter/printer ribbons for providing engagement between a drive means and a medium which is to be advanced with the aid of the drive means, the friction device including a counter pressure roller.

BACKGROUND

In advancing ribbons in printers and typewriters the ribbon is pulled by a drive means past the printing location. The drive means co-acts with the printing means of the printer such that for each character that is written the ribbon is pulled forward a given length corresponding to a type width plus margin. In order that the ribbon will not slip on engagement with the drive means, there is arranged a counter pressure roller which engages with spring bias against the drive wheel of the drive means. It is important here that the counter pressure roller engages against the drive wheel with the same pressure along its entire axial length. Otherwise, a transverse force may affect the movement of the ribbon and cause incorrect collection of used ribbon, with a breakdown as a result.

SUMMARY OF THE INVENTION

An object of the invention is to solve the above-mentioned problem in a simple and inexpensive way, by mounting the counter pressure roller on a flexible shaft, the force required for bending the shaft being taken up by the drive roller.

BRIEF DESCRIPTION OF THE DRAWING

The drawing illustrates schematically in a side view, partly on section, the parts of a printer/typewriter ribbon cassette which are of interest for the invention.

DETAILED DESCRIPTION OF THE EMBODIMENT

The cassette is represented by two end walls 1, 2 between which there are arranged a drive wheel 3 and a counter pressure roller 4. The drive wheel 3, which has a cylindrical surface with a surface coating of a friction material, e.g. hard rubber, is mounted with the aid of two pins 5, 6 in the end walls 1 and 2. The pin 6 is provided with a groove 7 at its free end for co-action with a projection on a pin in a drive means associated with the typewriter/printer for driving the ribbon (not illustrated in the FIGURE).

As with the drive wheel 3, the counter pressure roller 4 has a cylindrical surface of friction material, and through the roller there is an axial hole co-acting with a helix spring 8 with a running fit. Co-axial recesses 9 and 10 are arranged in the respective end portion of the roller 4. The end walls 1 and 2 are provided with projections 11 for axial guidance of the drive wheel 3 and counter pressure roller 4. Holes 13, 14 are arranged in the end walls for mounting the drive wheel shaft pins 5, 6 and holes 15, 16 for mounting the helix spring 8. The center-to-center distance between holes 13–15 and 14–16 is somewhat less than the sum of the radii of the drive wheel and counter pressure roller. As a result, the helix spring 8, constituting the shaft of the counter pressure roller 4, is subjected to bending in its parts which are not radially retained, as will be seen from the drawing.

What is claimed is:

1. A friction device for the advance of a ribbon of a printer or typewriter comprising a drive roller having an outer surface and a counterpressure roller bearing resiliently against the outer surface of the drive roller to frictionally advance a ribbon therebetween, said counterpressure roller having an axial hole therein, and a helical spring extending freely into said axial hole and having fixed ends mounted at a distance from the outer surface of the drive roller which is less than the radius of the counterpressure roller.

2. A friction device as claimed in claim 1 wherein the ribbon is contained in a cassette having opposite walls, said walls being provided with aligned holes, said ends of said helical spring being in said aligned holes.

3. A friction device as claimed in claim 2 wherein said helical spring extends freely from said aligned holes into the axial hole in said counterpressure roller.

4. A friction device as claimed in claim 3 wherein said counterpressure roller has recesses at opposite surfaces thereof, said helical spring extending in said recesses and said axial hole and being in a resiliently bent state therein.

* * * * *